US008294626B2

(12) United States Patent
Kuo

(10) Patent No.: US 8,294,626 B2
(45) Date of Patent: Oct. 23, 2012

(54) MULTI-BAND ANTENNA APPARATUS

(75) Inventor: Chao-Chiang Kuo, Hsinchu Hsien (TW)

(73) Assignee: MSTAR Semiconductor, Inc., Hsinchu Hsien (TW)

( * ) Notice: Subject to any disclaimer, the term of this patent is extended or adjusted under 35 U.S.C. 154(b) by 384 days.

(21) Appl. No.: 12/822,613

(22) Filed: Jun. 24, 2010

(65) Prior Publication Data

US 2011/0050522 A1 Mar. 3, 2011

(30) Foreign Application Priority Data

Sep. 2, 2009 (TW) ..... 98129587 A

(51) Int. Cl.
*H01Q 21/30* (2006.01)

(52) U.S. Cl. ..... 343/728; 343/893

(58) Field of Classification Search ..... 343/728, 343/725, 866, 893, 700 MS
See application file for complete search history.

(56) References Cited

U.S. PATENT DOCUMENTS 6,075,488 A * 6/2000 Hope ..... 343/702
6,239,755 B1 * 5/2001 Klemens et al. ..... 343/702
6,362,792 B1 * 3/2002 Sawamura et al. ..... 343/702
6,670,924 B1 * 12/2003 Shoji et al. ..... 343/702

* cited by examiner

*Primary Examiner* — Don Le
(74) *Attorney, Agent, or Firm* — WPAT., P.C.; Justin King

(57) ABSTRACT

A multi-band antenna apparatus is provided. The multi-band antenna apparatus comprises a circuit board, a planar printed antenna with a feed-in point and a telescopic antenna. The planar printed antenna is printed on the circuit board. The telescopic antenna is coupled to the circuit board through the feed-in point. The planar printed antenna receives a first radio frequency signal, and then transmits the first radio frequency signal to the circuit board through the feed-in point. The telescopic antenna receives a second radio frequency signal and then transmits the second radio frequency to the circuit board.

14 Claims, 7 Drawing Sheets

MULTI-BAND ANTENNA APPARATUS

CROSS REFERENCE TO RELATED PATENT APPLICATION

This patent application is based on Taiwan, R.O.C. patent application No. 098129587 filed on Sep. 2, 2009.

FIELD OF THE INVENTION

The present invention relates to an antenna, and more particularly to a multi-band antenna.

BACKGROUND OF THE INVENTION

As the improvement of mobile phone technologies continues, it is gradually essential for mobile phones to be capable of supporting wireless communication networks, such as Global System for Mobile communications (GSM), Global Positioning System (GPS), Bluetooth, WiFi, China Mobile Multimedia Broadcasting (CMMB), and Frequency Modulation (FM) broadcasting.

Since the minimization and integration of chips in mobile phones have become important topics, various antennas, in order to offer corresponding functions, also need to be minimized and multi-band supportive in response to such trend. Therefore, it is necessary to provide an antenna with a smaller utilization area of a feed-in point that simultaneously supports signals of various systems, so as to achieve the objects of reducing space and cost.

SUMMARY OF THE INVENTION

A multi-band antenna apparatus of the disclosure comprises a circuit board, a planar printed antenna with a feed-in point, and a telescopic antenna. The planar antenna is printed on the circuit board. The telescopic antenna is coupled to the circuit board through the feed-in point. The planar printed antenna receives a first radio frequency signal, and then transmits the first radio frequency signal to the circuit board through the feed-in point. The telescopic antenna receives a second radio frequency signal and then transmits the second radio frequency to the circuit board.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF THE PREFERRED EMBODIMENT

Figure 1:
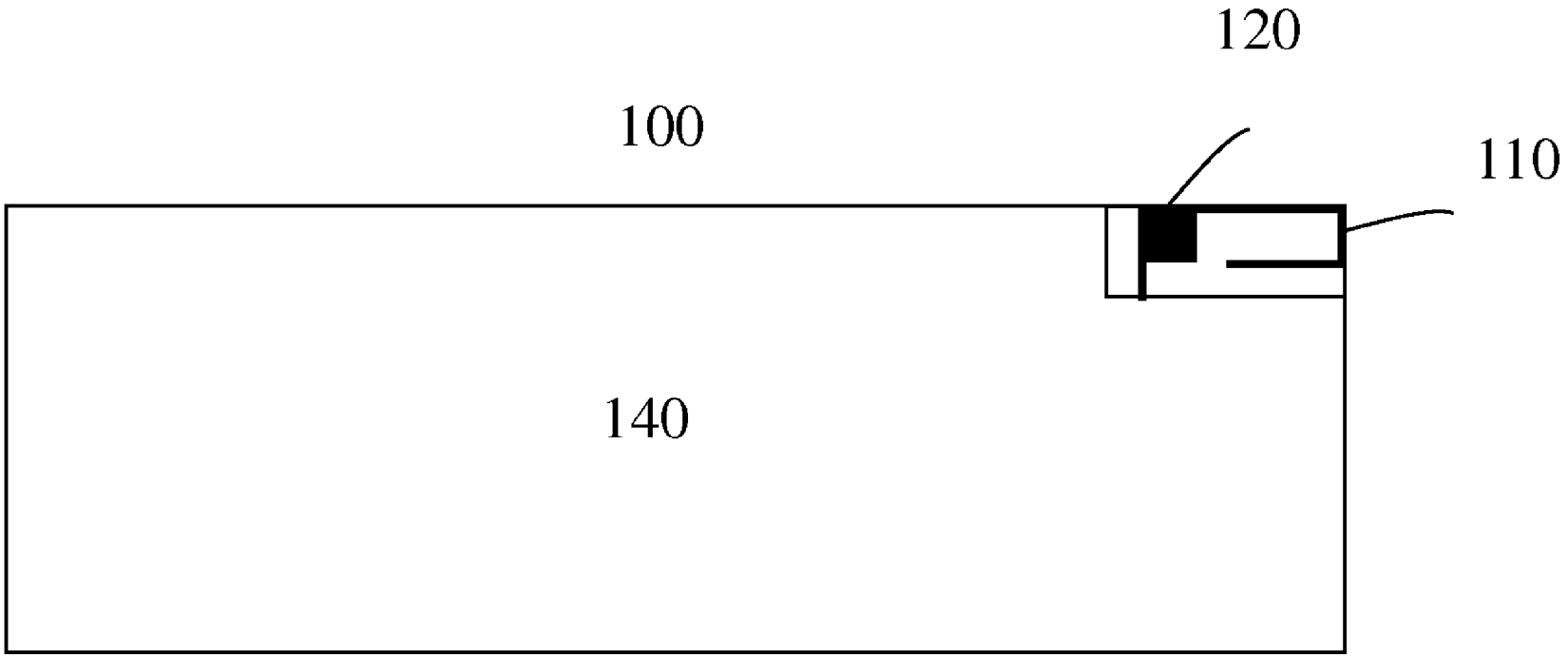
FIGURE 1 (PRIOR ART)
FIG. 1 is a diagram of an antenna apparatus comprising a planar printed antenna.

FIG. 1 is a diagram of an antenna apparatus 100. The antenna apparatus 100 comprises a planar printed antenna 110 with a feed-in point 120, and a circuit board 140. The planar printed antenna 110 is printed on the circuit board 140. Signals received by the planar printed antenna 110 are transmitted to the circuit board 140 through the feed-in point 120. In general, two or more resonators with different lengths are used in dual-band or multi-band antenna design to form required resonance points when current flows through different electrical paths. Therefore, one planar printed antenna 110 may receive both Bluetooth (BT) signals and Wireless Local Area Network (WLAN) signals of an Industry, Science, and Medicine (ISM) band, which is 2.4 GHz to 2.5 GHz.

Figure 2:
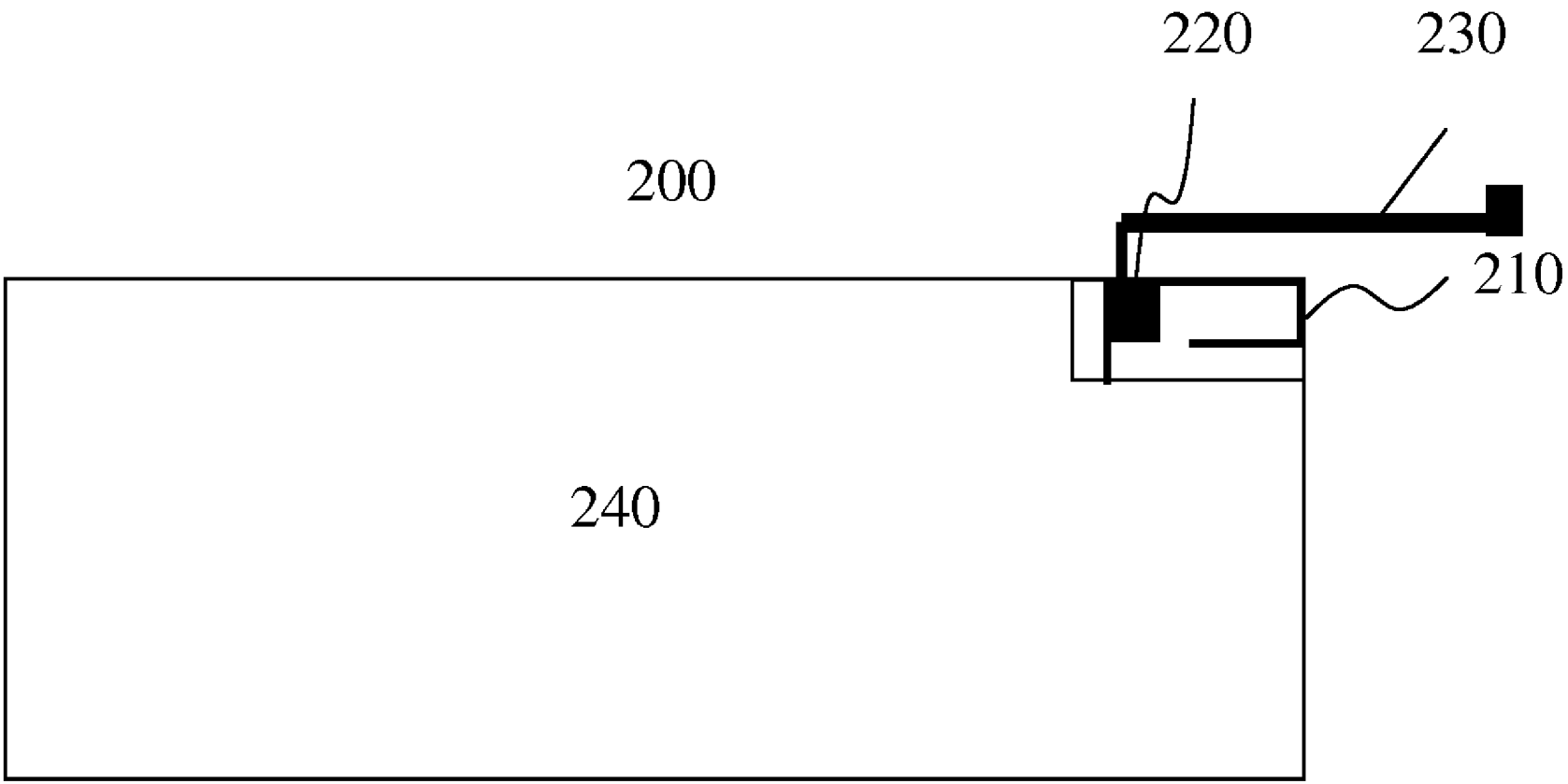
FIG. 2 is a diagram of a multi-band antenna apparatus according to one embodiment of the present invention.
Figure 3:
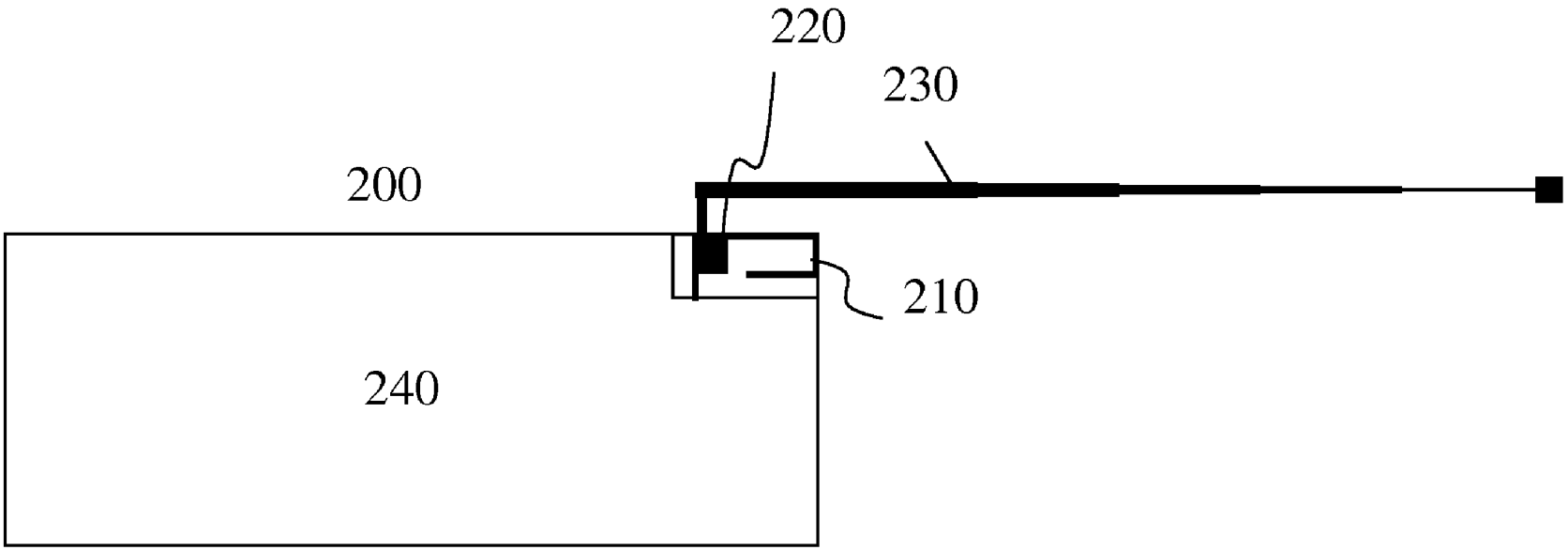
FIG. 3 is a diagram of a multi-band antenna apparatus according to one embodiment of the present invention.

FIG. 2 is a diagram of a multi-band antenna apparatus 200 according to one embodiment of the present invention. The multi-band antenna apparatus 200 comprises a circuit board 240 provided with a planar printed antenna 210 with a feed-in point 220, and a telescopic antenna 230. The telescopic antenna 230 may be extended to different lengths. FIG. 3 shows the fully extended telescopic antenna 230. Preferably, the planar printed antenna 210 may be a monopole antenna, an inverted L antenna (ILA), an inverted F antenna (IFA), a loop antenna, or a chip antenna. The planar printed antenna 210 is a high efficient resonator around 2.4 GHz to 2.5 GHz. The telescopic antenna 230 receives signals of very high frequency/ultra high frequency (VHF/UHF), such as China Mobile Multimedia Broadcasting (CMMB) signals in a frequency band of around 300 MHz to 800 MHz. The telescopic antenna 230 comes into contact with the planar printed antenna 210 through a feed-in point 220. The telescopic antenna 230 is also connected with the circuit board 240 through the feed-in point 220 for transferring an induced current, as shown in both FIG. 2 and FIG. 3. Therefore, this embodiment may be operated in systems of different frequency and different bands.

Figure 4:
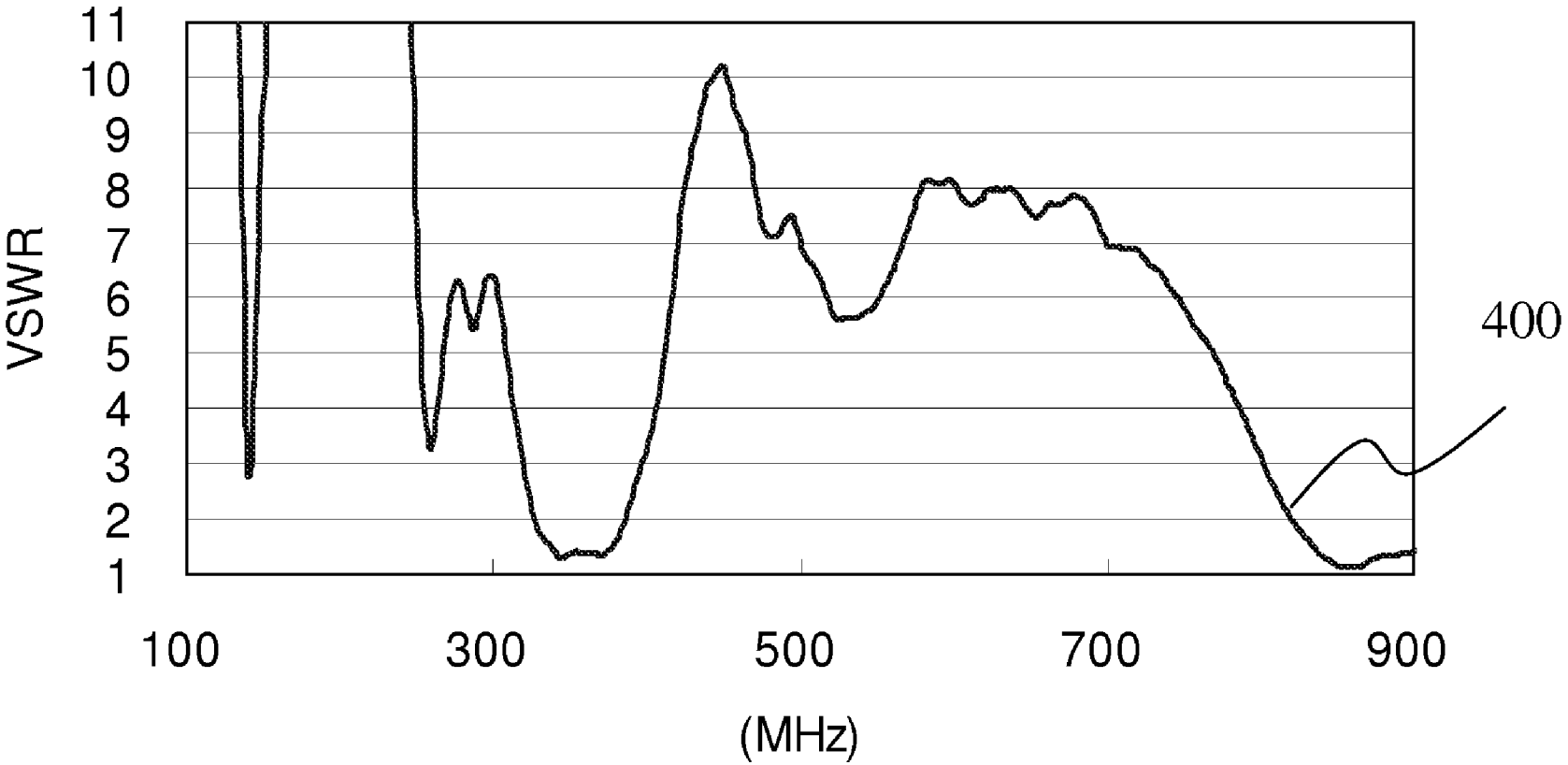
FIG. 4 is a diagram showing voltage standing wave ratio (VSWR) of a telescopic antenna.

FIG. 4 is a diagram showing a voltage standing wave ratio (VSWR) measured with the telescopic antenna 230 fully extended to 230 mm in length. The VSWR is an index of impedance match in a different medium when an electromagnetic wave is transmitted. The impedance match and the efficiency in receiving signals get better as the VSWR is closer to 1. The VSWR may be mathematically represented as:

$$VSWR = \frac{V_{max}}{V_{min}} = \frac{1+\rho}{1-\rho}.$$

$V_{max}$ is the sum of an amplitude $V_f$ of an incident wave and an amplitude $V_r$ of a reflected wave when the two waves interfere with each other constructively: $V_{max}=V_f+V_r=V_f+\rho V_f$, where ρ is an absolute value of a reflection coefficient:

$$\rho = \left|\frac{V_r}{V_f}\right|.$$

$V_{min}$ is the difference of the amplitude $V_f$ of the incident wave and the amplitude $V_r$ of the reflected wave when the two waves interfere with each other destructively: $V_{min}=V_f-V_r=V_f-\rho V_f$.

Figure 5:
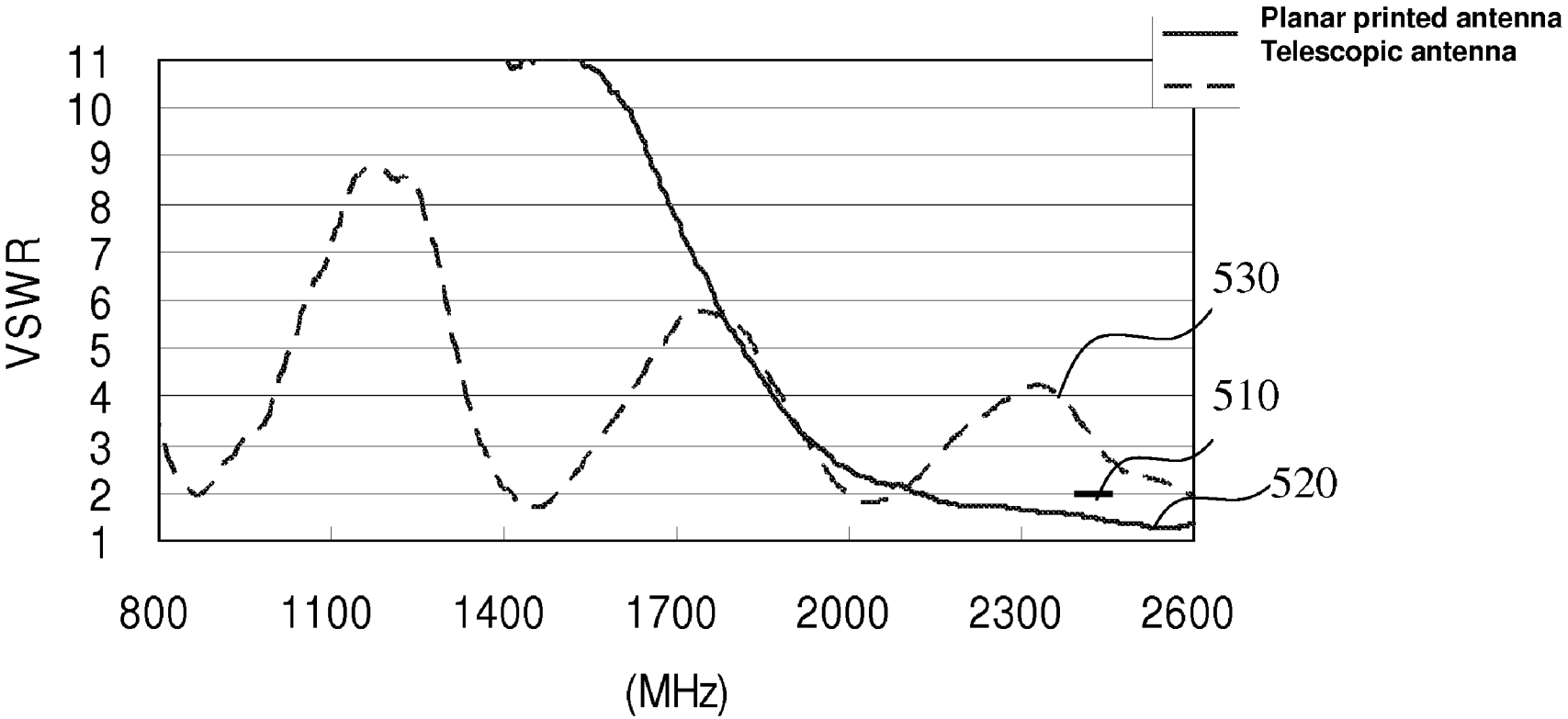
FIG. 5 is a diagram showing VSWR of an independent planar printed antenna and an independent telescopic antenna.

FIG. 5 is a diagram showing a VSWR of an independent planar antenna and a VSWR of an independent telescopic antenna. In FIG. 5, the curve or section 510 is the requirement of the VSWR for the antenna receiving ISM signals according to the specification. A curve 520 is a VSWR curve measured from the planar printed antenna 110 in FIG. 1 without the connection with the VHF/UHF telescopic antenna. The VSWR of the independent planar printed antenna 110 is less than 2 around the ISM band, and a resonance in the ISM band is formed. A curve 530 is a VSWR curve measured from an independent VHF/UHF telescopic antenna. The curve 530 shows that several resonance points with a VSWR less than 2 are formed in the frequency band higher than 800 MHz, apart from the ISM band which is around 2.4 GHz to 2.5 GHz.

Figure 6:
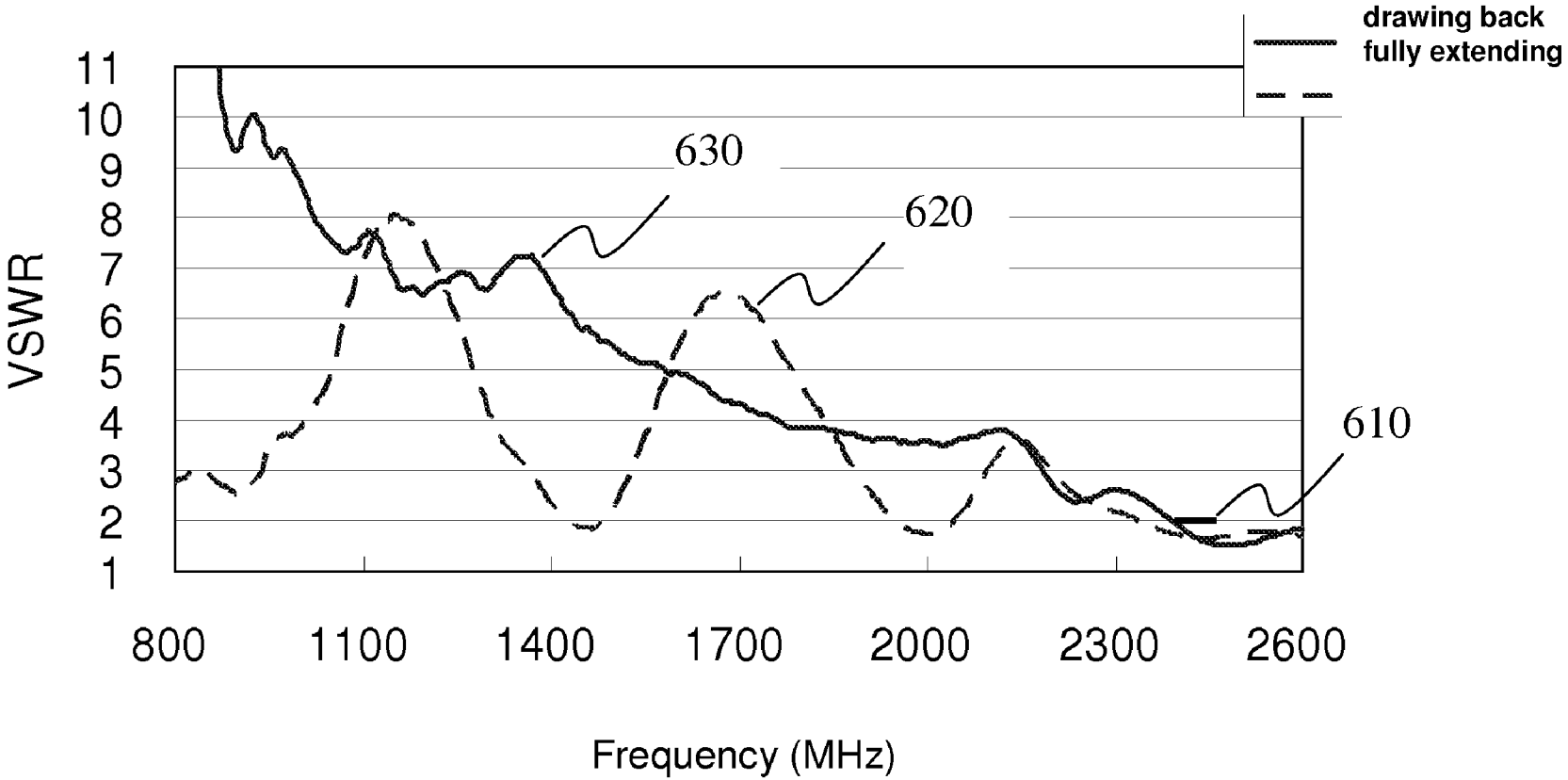
FIG. 6 is a diagram showing VSWR of the multi-band antenna apparatus according to one embodiment of the present invention.

FIG. 6 is a diagram of a measured VSWR of the multi-band antenna apparatus 200 of one embodiment of the present invention in FIG. 2 and FIG. 3. The curve or section 610 is the requirement of the VSWR for the antenna receiving ISM signals according to the specification. Curves 620 and 630 are measured VSWRs of the multi-band antenna apparatus 200 with the VHF/UHF telescopic antenna 230 fully extended and completely retracted respectively. For example, the fully extended telescopic antenna 230 is 230 mm in length. In the ISM band, the measured result shows that the VSWRs of the multi-band antenna apparatus 200 with telescopic antenna 230 fully extended or completely retracted are less than 2, as required by the specification. More specifically, because the resonance points within the ISM band of planar printed antenna 210 still exist, the resonance points of the telescopic antenna 230 are combined with the existing resonance points of the planar printed antenna 210 around the ISM band so that the VSWR is kept smaller than 2 as required by the specification.

Figure 7:
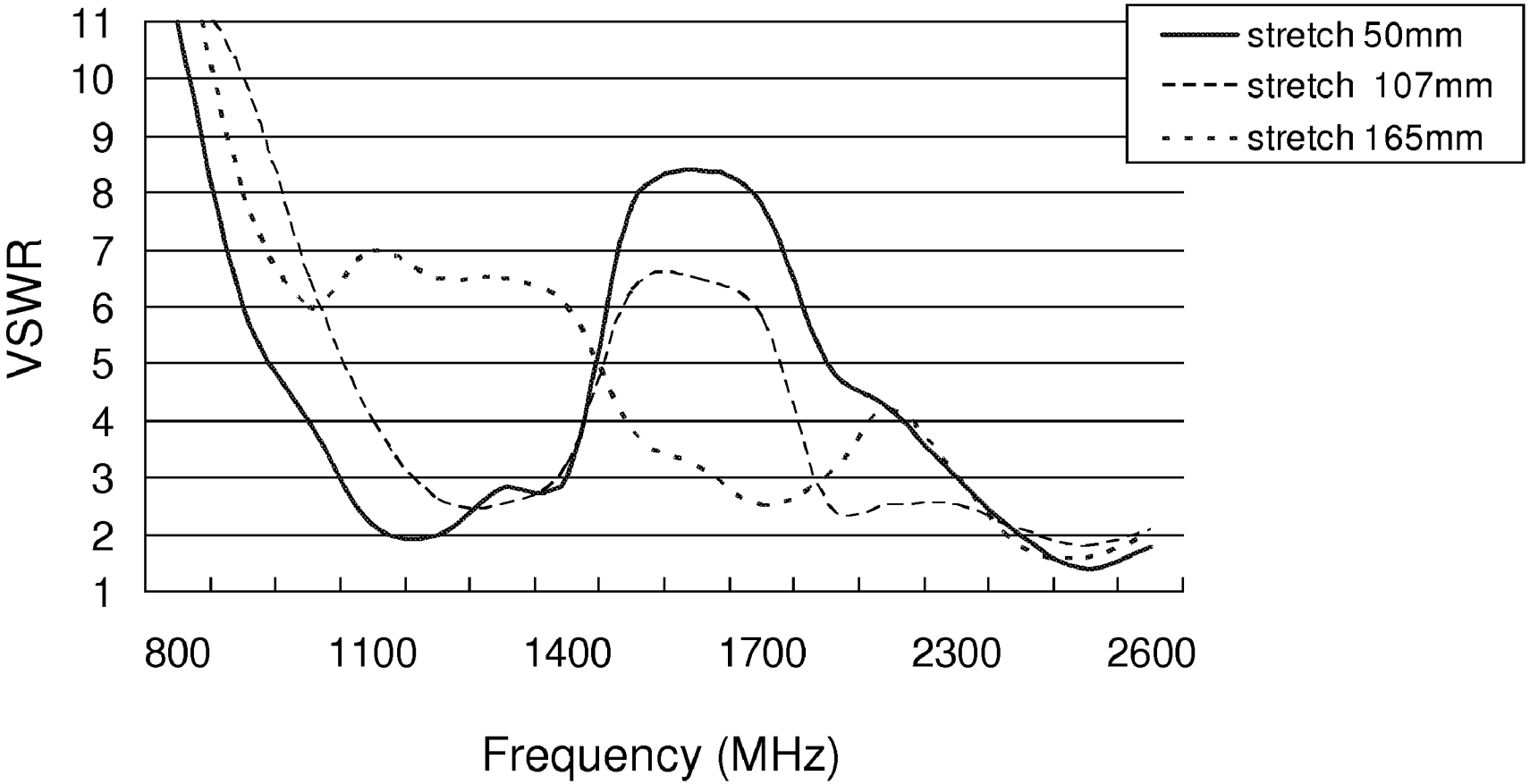
FIG. 7 is a diagram showing VSWR of the multi-band antenna apparatus according to one embodiment of the present invention.

FIG. 7 is a diagram of measured VSWRs of the VHF/UHF telescopic antenna 230 in different lengths comprised in the multi-band antenna apparatus 200. The telescopic antenna 230 is extended from 0 mm to 230 mm in length according to this embodiment. A curve 710 is a required VSWR curve for the antenna receiving ISM signals according to the specification. Curves 720, 730 and 740 are VSWR curves of the telescopic antenna 230 being extended to 50 mm, 107 mm, and 165 mm in length respectively. Although the corresponding frequencies of some resonance points vary with the extended length of the telescopic antenna 230, the VSWRs of three curves are still less than 2 within the ISM band, as shown in FIG. 7. According to FIG. 6 and FIG. 7, the BT/WLAN planar printed antenna 210 and the VHF/UHF telescopic antenna 230, both provided in the multi-band antenna apparatus 200 in FIG. 2, are capable of normal receiving and transmitting operations regardless of the extended length of the telescopic antenna 230 is.

Table 1 shows measured results of antenna efficiency according to one embodiment of the present invention. The antenna efficiency $\eta$ is a ratio of the effective radiation power $P_{rad}$ to the antenna input power $P_{in}$:

$$\eta = \frac{P_{rad}}{P_{in}},$$

$$\text{and } P_{rad} = \int_0^{2\pi}\int_0^{\pi} U(\theta, \phi)\sin(\theta)d\theta d\phi;$$

where $U(\theta,\phi)$ is radiation intensity of the antenna and is a function of angles $\theta$ and $\phi$.

Table 1 shows the antenna efficiency of integrating the BT/WLAN planar printed antenna and the VHF/UHF telescopic antenna according to the embodiment of the present invention is not only kept satisfactory but also larger than 30% required for BT/WLAN antenna efficiency in most mobile systems. Table 1 also shows that the antenna efficiency and resonant points do not vary greatly along with different extended lengths of the VHF/UHF telescopic antenna. Therefore, users may access BT/WLAN and receive digital television signals in VHF/UHF bands at the same time. Further, for designers and manufacturers of mobile phones, the number of pins on a chip and space for antenna arrangement may both be saved.

TABLE 1

| | antenna efficiency | | | |
|---|---|---|---|---|
| frequency (MHz) | planar printed antenna only | planar printed antenna + Telescopic antenna with extending length 0 mm | planar printed antenna + Telescopic antenna with extending length 150 mm | planar printed antenna + Telescopic antenna with extending length 230 mm |
| 2400 | >40% | >35% | >40% | >40% |
| 2450 | >40% | >35% | >40% | >40% |
| 2500 | >40% | >35% | >40% | >40% |

With description of the embodiments above, a multi-band antenna apparatus of the disclosure comprises a circuit board, a planar printed antenna with a feed-in point, and a telescopic antenna. The planar antenna is printed on the circuit board. The telescopic antenna is coupled to the circuit board through the feed-in point. The planar printed antenna receives a first radio frequency signal, and then transmits the first radio frequency signal to the circuit board through the feed-in point. The telescopic antenna receives a second radio frequency signal and then transmits the second radio frequency to the circuit board.

While the invention has been described in terms of what is presently considered to be the most practical and preferred embodiments, it is to be understood that the invention needs not to be limited to the above embodiments. On the contrary, it is intended to cover various modifications and similar arrangements included within the spirit and scope of the appended claims which are to be accorded with the broadest interpretation so as to encompass all such modifications and similar structures.

What is claimed is:

1. A multi-band antenna apparatus, comprising:

a circuit board;

a planar printed antenna, printed on the circuit board, comprising a feed-in point; and a telescopic antenna coupled to the circuit board through the feed-in point.

2. The multi-band antenna apparatus as claimed in claim 1, wherein the planar printed antenna receives a first radio frequency signal and transmits the first radio frequency signal to the circuit board through the feed-in point.

3. The multi-band antenna apparatus as claimed in claim 2, wherein the telescopic antenna receives a second radio frequency signal and transmits the second radio frequency signal to the circuit board.

4. The multi-band antenna apparatus as claimed in claim 1, wherein the planar printed antenna receives a radio frequency signal of an Industry, Science, and Medicine (ISM) band.

5. The multi-band antenna apparatus as claimed in claim 1, wherein the planar printed antenna receives a Bluetooth signal.

6. The multi-band antenna apparatus as claimed in claim 1, wherein the planar printed antenna receives a Wireless Local Area Network (WLAN) signal.

7. The multi-band antenna apparatus as claimed in claim 1, wherein the telescopic antenna receives a very high frequency/ultra high frequency (VHF/UHF) signal.

8. The multi-band antenna apparatus as claimed in claim 1, wherein the telescopic antenna receives a China Mobile Multimedia Broadcasting (CMMB) signal.

9. The multi-band antenna apparatus as claimed in claim 1, wherein the planar printed antenna is a monopole antenna.

10. The multi-band antenna apparatus as claimed in claim 1, wherein the planar printed antenna is an inverted L antenna (ILA).

11. The multi-band antenna apparatus as claimed in claim 1, wherein the planar printed antenna is an inverted F antenna (IFA).

12. The multi-band antenna apparatus as claimed in claim 1, wherein the planar printed antenna is a loop antenna.

13. The multi-band antenna apparatus as claimed in claim 1, wherein the planar printed antenna is a chip antenna.

14. The multi-band antenna apparatus as claimed in claim 1, wherein the planar printed antenna occupies a predetermined area on the circuit board and the feed-in point resides in the predetermined area.

* * * * *